United States Patent [19]

Kloster

[11] Patent Number: 4,576,066

[45] Date of Patent: Mar. 18, 1986

[54] TOOL FOR REMOVING FASTENERS FROM SHOCK ABSORBER CYLINDERS

[76] Inventor: Kenneth D. Kloster, 6649 Millridge, Maumee, Ohio 43537

[21] Appl. No.: 475,894

[22] Filed: Mar. 16, 1983

Related U.S. Application Data

[63] Continuation-in-part of Ser. No. 242,378, Mar. 10, 1981, abandoned.

[51] Int. Cl.[4] ..... B25B 13/10; B25B 13/56

[52] U.S. Cl. ..... 81/176.3; 81/124.2; 81/442

[58] Field of Search ..... 81/90 B, 90 C, 121 R, 81/121 A, 121 B, 164, 442

[56] References Cited

U.S. PATENT DOCUMENTS

| | | | |
|---|---|---|---|
| 1,872,392 | 8/1932 | Bishman et al. | 81/90 C UX |
| 2,386,254 | 10/1945 | Meyer | 81/90 C |
| 2,445,905 | 7/1948 | Busby | 81/121 A |
| 2,690,284 | 9/1954 | Cunningham | 81/90 C X |
| 3,575,069 | 4/1971 | White | 81/177 A X |
| 3,742,789 | 7/1973 | Rusk et al. | 81/90 C |

FOREIGN PATENT DOCUMENTS

| | | | |
|---|---|---|---|
| 216794 | 6/1924 | United Kingdom | 81/90 C |

*Primary Examiner*—James G. Smith

*Attorney, Agent, or Firm*—Marshall & Melhorn

[57] ABSTRACT

The present invention relates to a tool for removing threaded fasteners of varying configurations of the type commonly employed to retain a vehicle shock absorber in an associated cylindrical shroud. The tool comprises a main body portion of a generally rectangular box-like configuration having a plurality of fastener engaging means formed on the surfaces thereof. Each of the fastener engaging means has a separate fastener engaging configuration for engagement with a particular type of fastener. The main body has at least one keyway formed to extend along a portion of one of the outer surfaces of the body, with a piston rod receiving channel extending through the body and terminating in the keyway. A pair of spaced apart keys are slidably mounted in the keyway of the body. Each of the keys has a fastener engaging means formed thereon for engagement with a particular type of threaded fastener. In one embodiment, a pair of handles extend in opposite directions from the main body and are utilized to operate the tool when the associated suspension unit is removed from the vehicle. In the event the suspension remains partially attached to the vehicle, an elongate extension unit is utilized to insert the main body through an access hole typically provided in the inner vehicle fender panel and position the main body on top of the associated fastener.

8 Claims, 12 Drawing Figures

TOOL FOR REMOVING FASTENERS FROM SHOCK ABSORBER CYLINDERS

CROSS-REFERENCE TO RELATED APPLICATION

This application is a continuation-in-part application of my copending application Ser. No. 242,378, filed March 10, 1981 now abandoned.

BACKGROUND OF THE INVENTION

One type of vehicle suspension system which is becoming increasingly popular is the MacPherson strut suspension system. The MacPherson strut is an integral coil spring-shock absorber assembly which provides a lightweight, compact component of a vehicle suspension system. The MacPherson strut suspension system is disclosed in more detail in U.S. Pat. No. 2,624,592 to E. S. MacPherson.

One of the problems associated with MacPherson strut assemblies is related to the replacement of a worn shock absorber unit. One solution to this problem is to manufacture the MacPherson strut assembly with a construction which permits the shock absorber unit to be readily removed and replaced with a new shock absorber. In this type of MacPherson strut assembly, the shock absorber unit is typically maintained within a cylindrical shroud by means of a threaded fastener attached to one end of the cylindrical shroud. However, one problem associated with the threaded fasteners is that each manufacturer typically designs its fastener such that a special tool configuration is required to remove the fastener from the associated shroud.

A solution to this problem has been presented by one company, Branick Manufacturing of Fargo, N. Dak., which markets a tool that can be utilized to remove the majority of threaded fasteners present on the market today. The tool includes a handle portion having a means for supporting a separate socket unit specifically designed to remove a particular fastener configuration. A plurality of individual sockets, each of which is designed to remove a particular fastener, are typically provided with the handle assembly.

SUMMARY OF THE INVENTION

The present invention relates to a tool for removing a threaded fastener of the type commonly employed to retain a shock absorber unit within an associated cylindrical shroud of a MacPherson strut suspension assembly. The shock absorber includes a piston rod extending axially from one end of the shroud and through the associated fastener. The tool comprises a main body having a plurality of fastener engaging means incorporated therein with each of the engaging means having a separate fastener engaging configuration for engagement with a particular type of fastener.

More specifically, the main body has at least one keyway formed to extend along a portion of the outer surface of the main body, with a piston rod receiving channel extending through the main body and terminating in the keyway. The keyway is adapted to extend radially relative to the piston rod receiving channel. A pair of spaced apart keys are mounted in the keyway of the main body and are adapted to slide radially relative to the piston rod receiving channel. Each of the keys has a fastener engaging means formed thereon for engagement with an associated threaded fastener.

The main body is typically formed of a rectangular box-like configuration and includes a second piston rod receiving channel formed therein in perpendicular relation to the first channel. This type of construction provides four separate surfaces for carrying the plurality of fastener engaging means. A plurality of fastener engaging means can be formed on each of the four surfaces. These fastener engaging means can be, for example, in the form of an octagonally-shaped cutout to receive similarly formed fasteners. A second keyway can be formed to extend along another one of the outer surfaces to receive a second pair of spaced apart keys which can include fastener engaging means of a different configuration than those located on the first pair of keys.

In one embodiment of the invention, a pair of elongate handles are releasably secured to the main body and extend in opposite directions therefrom. Such an arrangement provides an effective tool for removing a threaded fastener from a shock absorber unit which has been removed from the associated vehicle. In the event the threaded fastener is to be removed from a suspension unit which remains attached to the vehicle, an alternate embodiment of the tool provides for a hollow extension unit having a lower end which is adapted to be attached to the surface of the main body opposite the surface carrying the desired fastener engaging means. The upper end of the extension unit is provided with means for coupling the tool to a driver tool such as a conventional ratchet wrench or a torque wrench. Such an arrangement provides a tool which enables an operator to insert the main body through an access hole typically provided in the upper portion of the inner vehicle fender panel and position the main body on top of the associated fastener. A conventional ratchet wrench can then be coupled to the upper end of the extension unit to remove the fastener.

BRIEF DESCRIPTION OF THE DRAWINGS

The above, as well as other features and advantages of the invention, will become readily apparent to one skilled in the art when reading the following detailed description of the invention when considered in light of the accompanying drawings, in which.

DESCRIPTION OF THE PREFERRED EMBODIMENT

Figure 1:
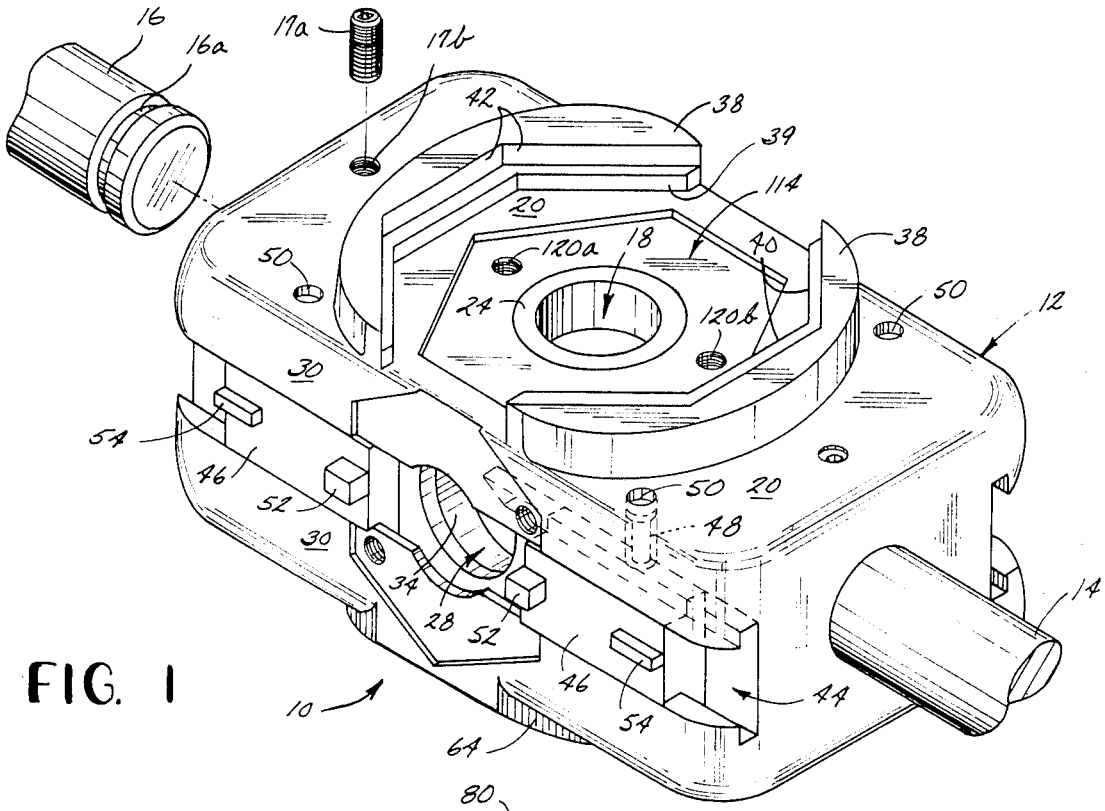
FIG. 1 is a perspective view illustrating three sides of a main body of a tool embodying the features of the present invention.
Figure 2:
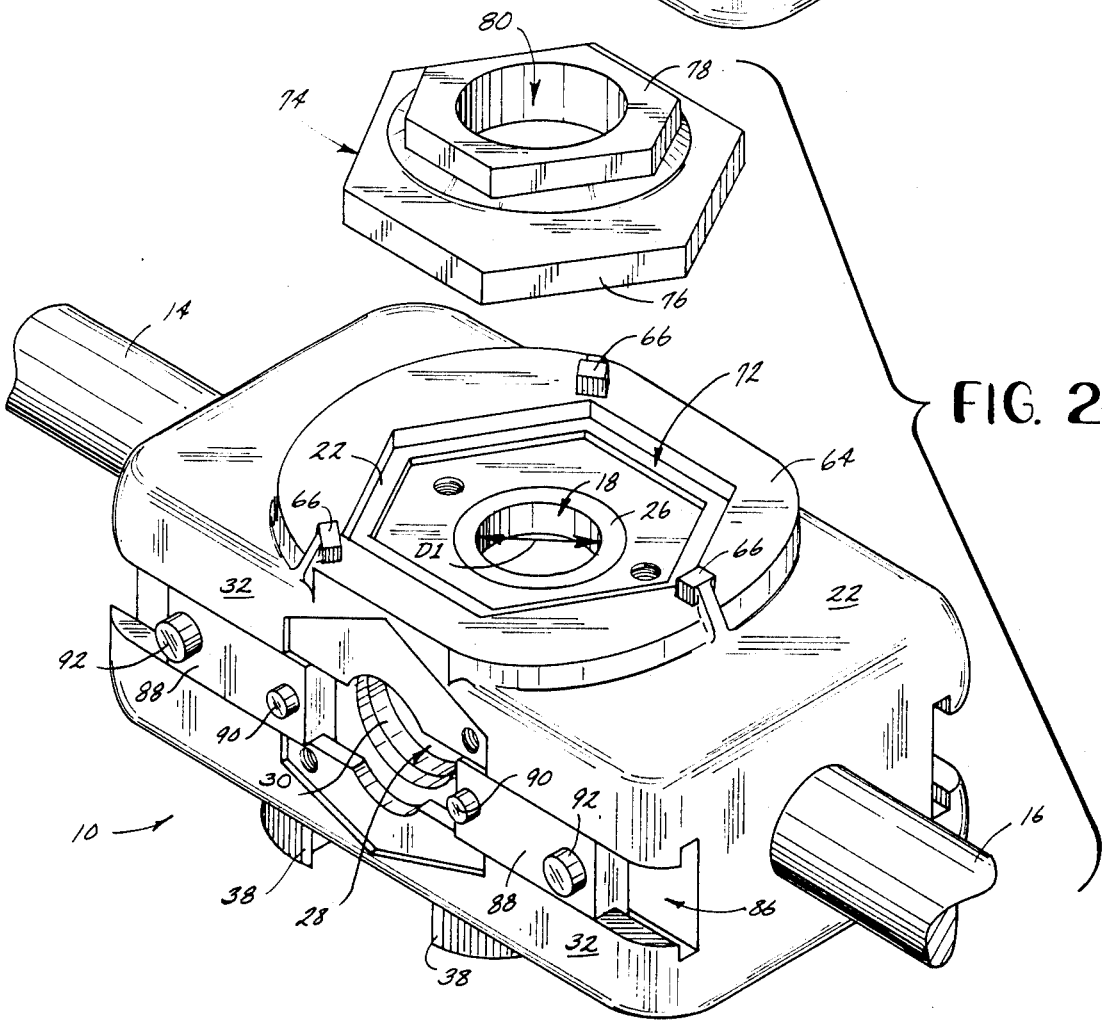
FIG. 2 is a perspective view, similar to FIG. 1, but showing the opposite three sides of the main body, along with an adapter element which can be utilized in combination with the main body to remove a particular fastener configuration.

Referring to FIGS. 1 and 2, there is shown a tool, generally indicated by reference numeral 10, embodying the features of the present invention. The tool 10 includes a main body 12 having a pair of handles 14 and 16 releasably secured to the main body and extending in opposite directions therefrom. As shown in FIG. 1, the handle 16 can be releasably secured to the main body 12 by means of a set screw 17*a* which is threaded into an aperture 17*b* and is adapted to extend into an annular groove 16*a* formed on the inner end of the handle 16. The handle 14 can be releasably secured to the main body 12 in a similar manner.

The main body 12 includes a plurality of fastener engaging means for engaging a plurality of threaded fasteners of the type commonly utilized to retain a shock absorber unit within the shroud of a MacPherson strut assembly. Examples of such prior art threaded fasteners are shown in FIGS. 4 through 9. The main body 12 is of a generally rectangular box-like configuration and has a plurality of fastener engaging means formed on each of the four sides to which the handles 14 and 16 are not attached.

In order to utilize all four available surfaces of the rectangular main body 12, a pair of piston rod receiving channels are formed therethrough in a perpendicular relationship with one another. A first channel 18 begins at a surface 20 (FIG. 1) and extends through the main body where it terminates at the surface 22 (FIG. 2). A pair of plastic sleeves 24 and 26 are positioned within the channel 18 adjacent the surfaces 20 and 22, respectively, to support the tool around the associated piston rod of the shock absorber without marring the surface thereof. A second piston rod receiving channel 28 begins at the surface 30 (FIG. 1) and extends through the main body, intersecting the channel 18, and terminating at the surface 32 (FIG. 2). As was the case for the first channel 18, a pair of plastic sleeves 34 and 36 are positioned within the channel 28 near the ends thereof to support the main body about the shock absorber piston rod. As clearly shown in FIGS. 2 and 3, the piston rod receiving channels 18 and 28 can be formed with a diameter D1 substantially equal to the diameter of the piston rod 102 in order to properly position the tool on the associated threaded fastener.

The various fastener engaging means incorporated on the main body 12 will now be discussed. In FIG. 1, the outer surface 20 has a pair of upwardly extending wall members 38 having inner wall surfaces 39 which, in conjunction with the gap between wall members 38, define an octagonal recess for removing a fastener 40 of the type shown in FIG. 4. The inner wall surfaces 39 are adapted to engage the octagonal periphery 41 of the threaded fastener 40. The wall members 38 also include inner wall surfaces 42 which are positioned above and outwardly of the wall surfaces 40 to define a similar, but larger, octagonal recess.

In FIG. 1, the surface 30 has an elongate keyway 44 formed therein for receiving a pair of spaced apart keys 46 which are slidably mounted within the keyway 44. The keys 46 have a generally T-shaped cross section which conforms with the keyway 44. The keys 46 can be adjustably positioned along the keyway 44 by means of a threaded set screw 48 mounted within threaded apertures 50 extending downwardly from the surface 20 into the keyway 44. The fastener engaging means mounted on the keys 46 include square-shaped projections 52 extending outwardly from the inner ends of the key 46 and rectangular-shaped projections 54 extending outwardly from the outer ends of the keys 46. The particular fastener engaging means which are to be utilized to remove a particular fastener are positioned on the inner ends of the keys 46. For example, the projections 52 can be utilized to engage notches 56 of a threaded fastener 58 shown in FIG. 5. If it is desired to remove a cap of the type shown in FIG. 6, the keys 46 can be removed from the keyway 44 and reversed such that the rectangular projections 54 now appear at the inner ends of the keys 46. The projections 54 can then be utilized to engage a slot 60 formed along the top of a threaded fastener 62.

Referring to FIG. 2, the surface 22 includes a generally circular raised portion 64 having three circumferentially-spaced, upstanding projections 66 extending therefrom. The projections 66 provide a fastener engaging means to remove a threaded fastener of the type shown in FIG. 7. The projections 66 can engage three circumferentially-spaced notches 68 positioned around the outer rim of a threaded fastener 70.

The raised portion 64 has a hexagonally-shaped recess 72 adapted to receive an adapter element 74. The adapter element 74 includes a lower hexagonally-shaped base 76 which seats within the recess 72 and an upwardly extending hexagonal portion 78. A piston rod channel 80 is centrally located in the adapter element 74. The adapter element 74 is utilized in conjunction with the main body 12 to remove a threaded fastener of the type shown in FIG. 8. The hexagonal portion 78 is designed to fit within a hexagonal cutout 82 formed in the top wall of the threaded fastener 84. The hexagonal recess 72 in the main body 12 is then utilized to receive the larger hexagonal portion 76.

The surface 32 has an elongate keyway 86 formed therein for receiving a pair of spaced apart keys 88 which are slidably mounted within the keyway 86. The keys 88 have a generally T-shaped cross section which conforms with the keyway 86. The keys 88 can be adjustably positioned along the keyway 86 by means of a threaded set screw arrangement similar to the set screw arrangement utilized to secure the keys 46 shown in FIG. 1. The fastener engaging means mounted on the keys 88 include cylindrical pin projections 90 extending outwardly from the inner ends of the keys 88 and slightly larger cylindrical pin projections 92 extending outwardly from the outer ends of the key 88. The projections 90 can be utilized to remove a threaded fastener of the type shown in FIG. 9. The keys 88 can be positioned along the keyway 88 at a position to permit the projections 90 to be received within circular cutouts 94 of a threaded fastener 96. As was the case for the keys 46 shown in FIG. 1, the keys 88 can be removed from the keyway 86 and reversed such that the larger diameter pins 92 can be utilized to remove a threaded fastener having circular cutouts of a larger diameter.

Figure 3:
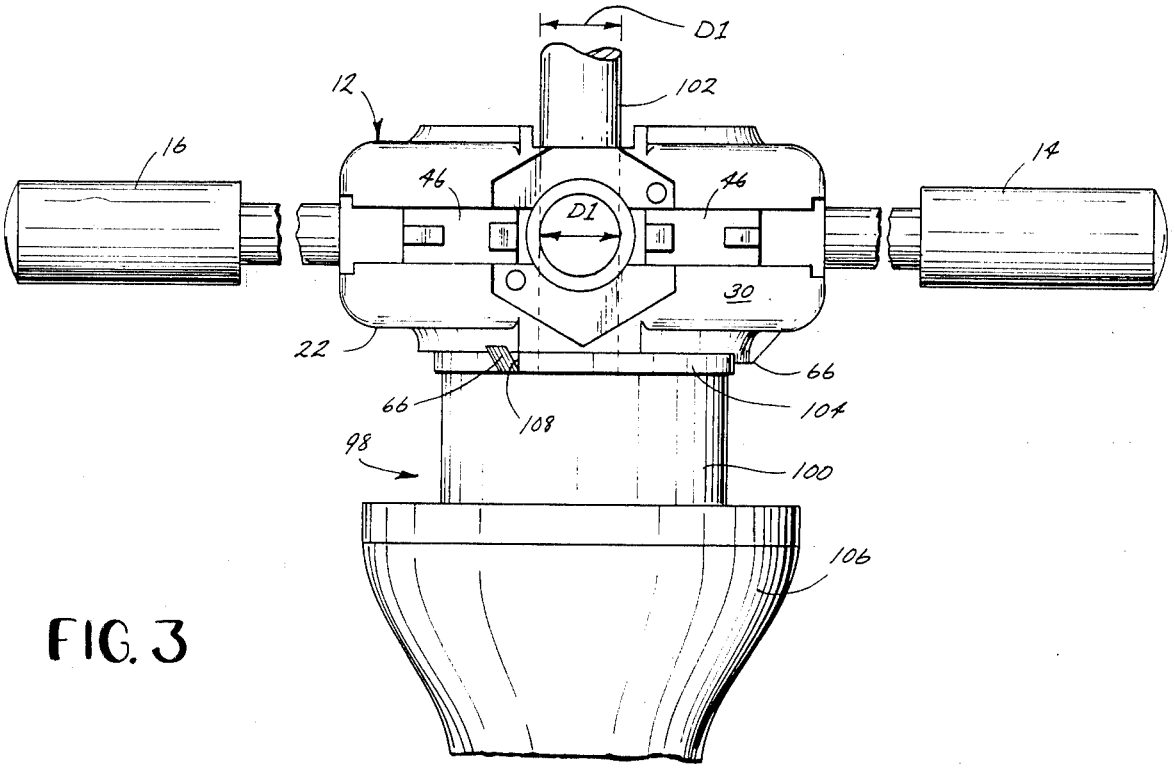
FIG. 3 is a side view of a portion of a MacPherson strut suspension assembly showing the tool of FIGS. 1 and 2 positioned thereon to remove the associated threaded fastener.
Figure 4:
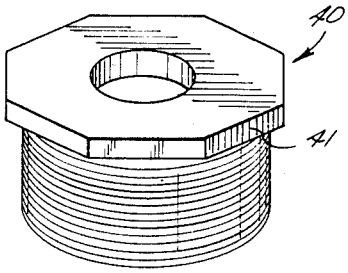
(PRIOR ART) FIG. 4
FIGS. 4 through 9 illustrate examples of six types of prior art threaded fasteners which the tool according to the present invention is designed to remove.
Figure 5:
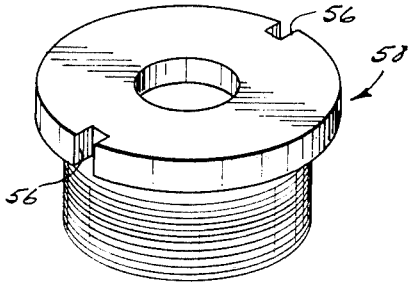
(PRIOR ART) FIG. 5
Figure 6:
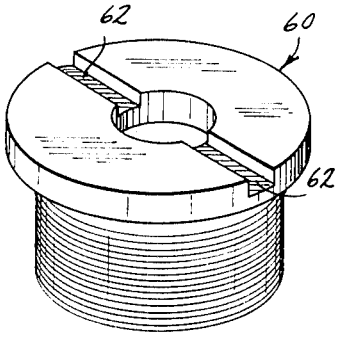
(PRIOR ART) FIG. 6
Figure 7:
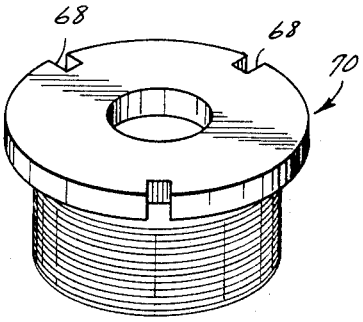
(PRIOR ART) FIG. 7
Figure 8:
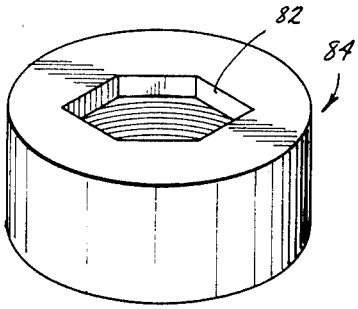
(PRIOR ART) FIG. 8
Figure 9:
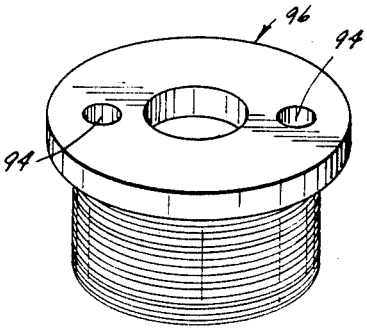
(PRIOR ART) FIG. 9

FIG. 3 illustrates the general operational position of the tool 10. A MacPherson strut assembly 98 includes a cylindrical shroud 100 which contains a shock absorber unit (not shown) having a piston rod 102 extending axially from the upper end of the shroud 100. A threaded fastener 104, similar to the threaded fastener shown in FIG. 7, is threadably secured to the upper end of the shroud 100. A lower spring support platform 106 surrounds the shroud member 100. When it is desired to remove the threaded fastener 104, the user inserts the piston rod 102 through the piston rod receiving channel 18 such that the surface 22 of the body 12 is facing downwardly. The main body 12 is rested upon the top of the fastener 104 and rotated until the projections 66 are received within notches 108 formed in the outer rim of the fastener 104. The tool can then be rotated to remove the fastener.

It will be appreciated that the keys 46 or 88 can be replaced with an alternate set of keys having different fastener engaging means formed thereon to increase the application of the tool.

Figure 10:
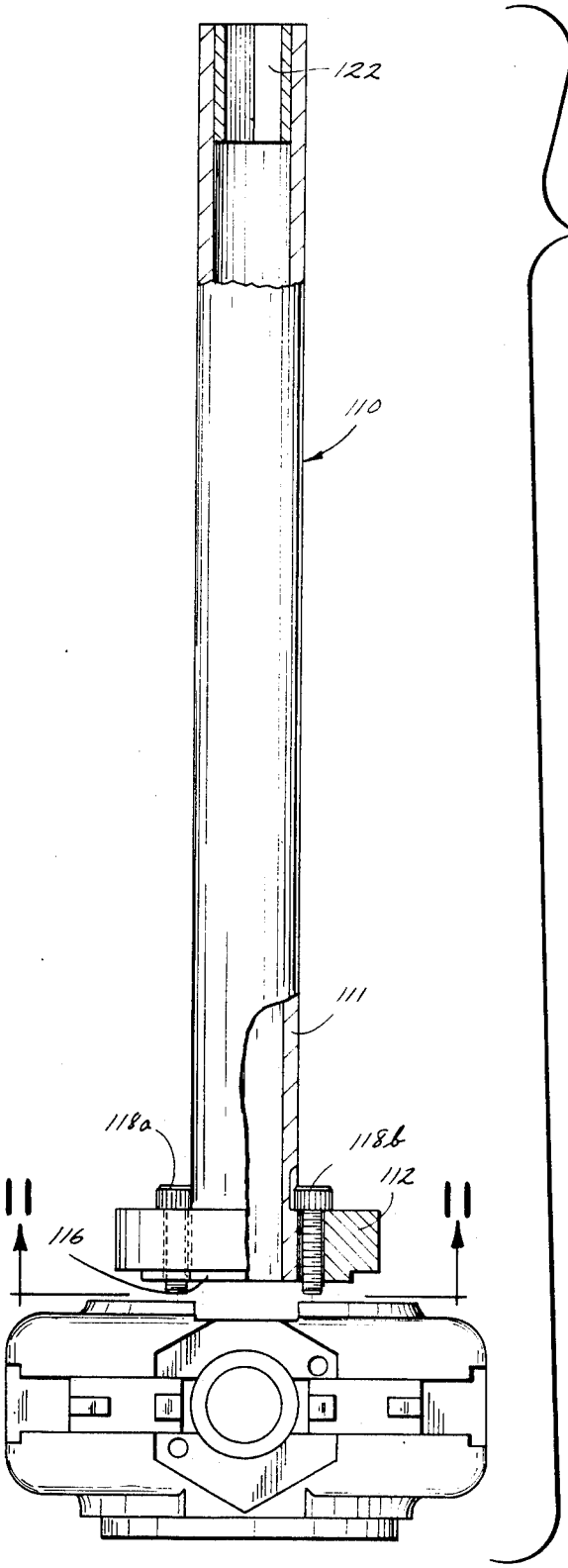
FIG. 10 is a side view, partly in section, of an alternate embodiment of the present invention incorporating an extension unit which enables the tool to remove the threaded fastener of a suspension assembly while the suspension assembly remains attached to the associated vehicle.
Figure 11:
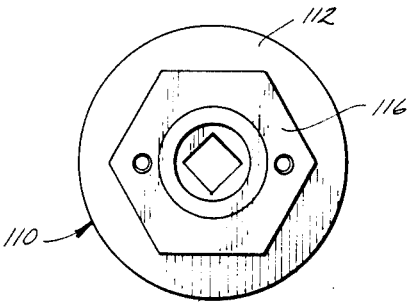
FIG. 11 is a bottom plan view of the extension unit taken along the line 11—11 of FIG. 10.

Referring to FIG. 10, there is shown an extension unit 110 which can be utilized in place of the handles 14 and 16 for operating the main body 12. The driver unit 110 includes an elongate tube member 111 having a lower end secured to a lower flange member 112. The lower flange member 112 is adapted to be secured to a selected one of the main body surfaces 20, 22, 30 or 32. As shown in FIG. 1, the surface 20 is provided with a hexagonal recessed portion 114 which is adapted to receive a cooperating hexagonal raised portion 116 formed on the bottom of the flange member 112. A pair of spaced apart threaded fasteners 118*a* and 118*b* extend through the flange member 112 and are adapted to be threaded into the threaded apertures 120*a* and 120*b* formed within the recessed portion 114 of the surface 20. As shown in FIGS. 1 and 2, the other surfaces 30, 22 and 32 of the main body 12 are provided with similar hexagonal recessed portions and threaded apertures.

In operation, the flange portion 112 is secured to the surface of the main body 12 which is opposite the surface which carries the desired fastener engaging means. The upper end of the elongate tube member 111 is provided with a suitable driver engaging means such as a socket portion 122 which is adapted to be coupled to a conventional ratchet wrench or a torque wrench, for example.

Figure 12:
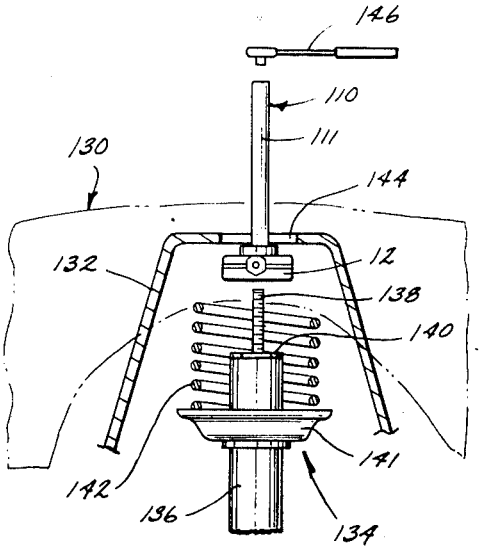
FIG. 12 is a side elevational view of the tool of FIG. 10 as it is inserted through an access hole provided in an inner vehicle fender panel.

As previously mentioned, the combination of the extension unit 110 and the main body 12 can be utilized to remove a threaded fastener of a vehicle suspension unit which remains attached to the vehicle. There is shown in FIG. 12 a schematic representation of a vehicle fender 130 (shown in phantom) along with the portion of a wheel well housing 132 to which the upper end of a MacPherson strut assembly 134 was attached. The strut assembly 134 shown in FIG. 12 is partially disassemble and includes a cylindrical shroud 136 having a shock absorber piston rod 138 extending through a threaded fastener 140. The strut assembly 134 also includes a lower spring support platform 141 attached to the shroud 136 for supporting a helical coil spring 142.

After the associated coil spring 142 has been compressed, the upper strut mount (not shown) and the upper spring retaining platform (not shown) can be removed to open an access hole 144 provided in the upper end of the wheel well housing 132. The main body 12 of the tool 10 can then be inserted through the access hole and positioned on top of the associated fastener 140. The piston rod 138 will pass through the respective piston rod receiving channel in the main body 12 and into the lower end of the tube 111. A conventional ratchet wrench 146 can then be used to operate the tool and remove the fastener 140. It should be noted that the main body 12 is typically constructed of a dimension which permits the main body 12 to be inserted through the access hole 144.

In accordance with the provision of the patent statutes, the principle and mode of operation of the invention have been explained in what is considered to represent its best embodiments. It should, however, be understood that the invention may be practiced otherwise than as specifically illustrated and described without departing from its spirit or scope.

What is claimed is:

1. A tool for removing a threaded fastener of the type employed to contain a vehicular shock absorber in an associated shroud, the shock absorber having a piston rod extending axially from one end of the shroud and through the associated fastener, the tool comprising:

a main body having at least one keyway formed to extend along a portion of the outer surface of said main body, a first piston rod receiving channel extending through said main body and terminating in said keyway, and a second piston rod receiving channel extending through said main body and intersecting said first channel; and a pair of spaced apart keys slidably mounted in said keyway of said main body, each of said keys having a fastener engaging means formed thereon for engagement with the threaded fastener to effect removal of the fastener.

2. A tool according to claim 1 including an elongate handle extending from said main body in a generally radial direction from said piston rod receiving channels.

3. A tool according to claim 1 wherein said fastener engaging means includes a projection extending outwardly from each of said keys.

4. A tool according to claim 1 including a plurality of fastener engaging means incorporated on the outer surface of said main body.

5. A tool according to claim 4 including an adapter element engagable with said main body, said adapter element including a fastener engaging means extending outwardly from said main body.

6. A tool according to claim 1 wherein said first piston rod receiving aperture extends perpendicular relative to a pair of opposed outer surfaces of said body, each of the opposed outer surfaces provided with a separate fastener engaging means.

7. A tool according to claim 1 including sleeve means positioned within at least one of said piston rod receiving channels for supporting said main body about the shock absorber piston rod.

8. A tool according to claim 1 including an elongate driver unit having a lower end adapted to be coupled to said main body unit and an upper end provided with a tool engaging means, said lower end of said driver unit provided with a piston rod receiving channel generally coaxial with one of said piston rod receiving channel of said main body.

* * * * *